United States Patent [19]

Cho

[11] Patent Number: 4,535,499

[45] Date of Patent: Aug. 20, 1985

[54] SHOE POLISHING DEVICE AND SERVO-APPLICATOR MEANS FOR USE THEREIN

[76] Inventor: Chun S. Cho, 554 Winslow Way East, Winslow, Wash. 98110

[21] Appl. No.: 583,010

[22] Filed: Feb. 23, 1984

[51] Int. Cl.[3] ..... A47L 23/06

[52] U.S. Cl. ..... 15/24; 15/97 R; 401/172

[58] Field of Search ..... 15/23, 24, 28, 29, 97 R, 15/21 E, 21 D, 30, 31, 34, 33

[56] References Cited

U.S. PATENT DOCUMENTS

| | | | |
|---|---|---|---|
| 1,562,377 | 11/1925 | Spielman | 15/24 |
| 2,882,538 | 4/1959 | Beeren | 15/24 |
| 2,999,257 | 9/1961 | Estrada | 15/24 |

*Primary Examiner*—Edward L. Roberts
*Attorney, Agent, or Firm*—Christopher Duffy

[57] ABSTRACT

The device is armed with servo-applicator means for applying shoe polishing compound to a rotor-driven applicator wheel which in turn transfers the polish to the shoe. The wheel may then be used to shine the shoe with the polish, or a substitute wheel may be used for this purpose, or if need be, an entirely separate means may be used for the purpose. The servo-applicator means may take the form of an insertible cartridge which is operable as a pushbutton-like applicator means on the device, or which can be separately employed as a handheld applicator means. The cartridge is commonly equipped with a stick of polishing compound, and in certain embodiments, the stick is removable from the cartridge, for purposes of renewing or replacing the compound, even while the cartridge is inserted in the device. In other embodiments, the cartridge is first removed from the device and then the compound is renewed or replaced before the cartridge is returned to the device. In preferred form, the device is adapted to be carried in one hand, and is equipped with a plurality of servo-applicator means having several different colors of polish therein.

20 Claims, 12 Drawing Figures

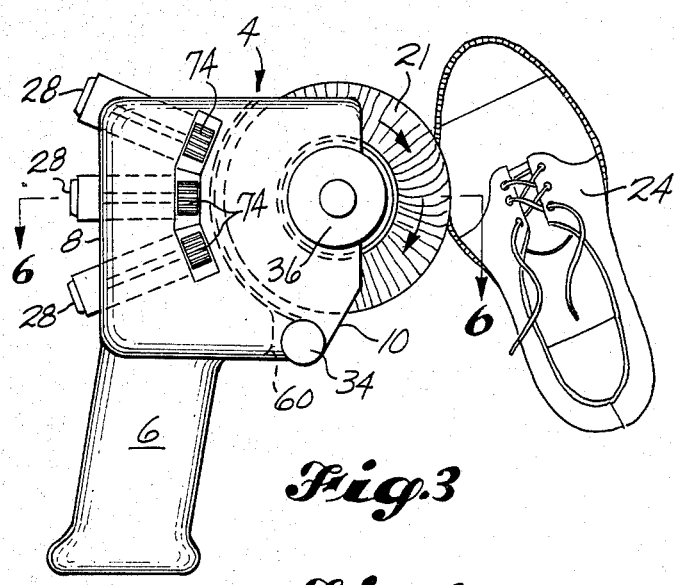
Fig.3
Fig.4
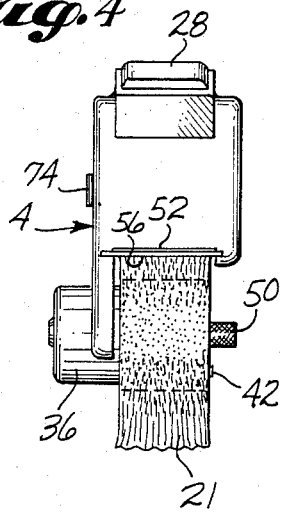
Fig.8
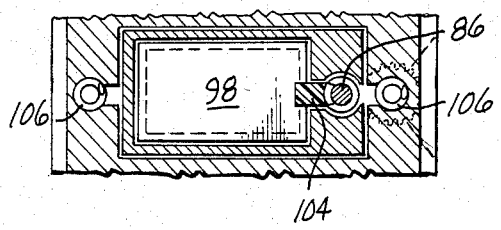
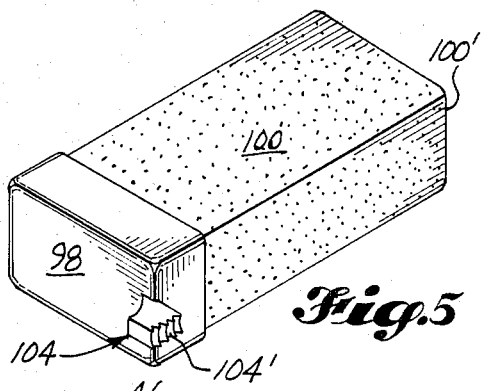
Fig.5
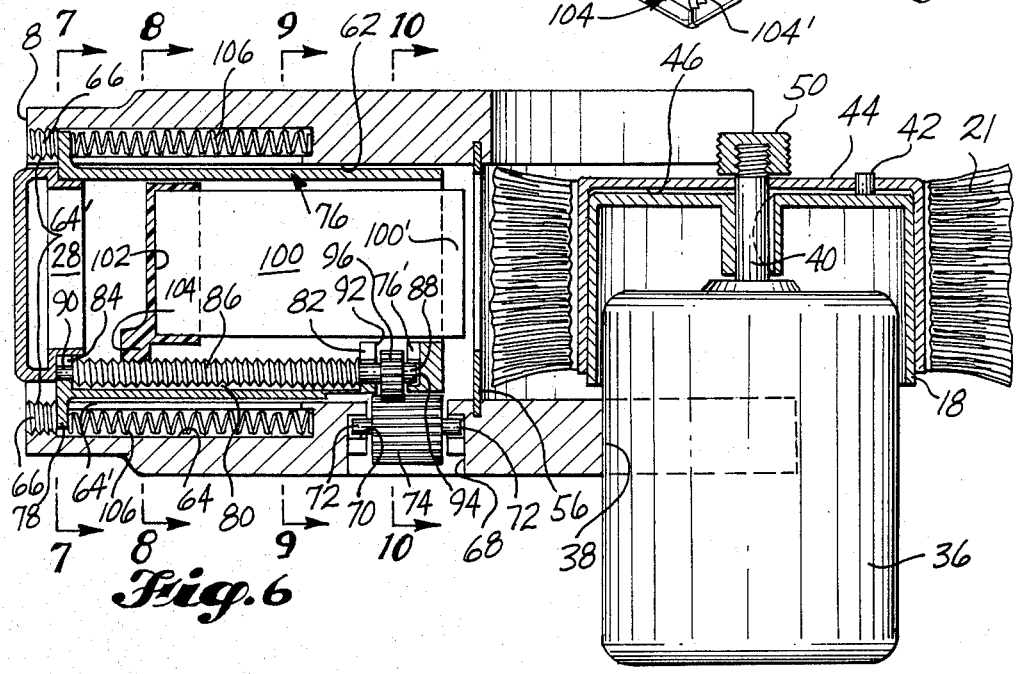
Fig.6

SHOE POLISHING DEVICE AND SERVO-APPLICATOR MEANS FOR USE THEREIN

THE INVENTION IN GENERAL

This invention relates to a shoe polishing device which is armed with servo-applicator means for applying a polishing compound to a rotor driven applicator wheel which in turn transfers the polish to the shoe. The wheel may then be used to shine the shoe with the polish, or a substitute wheel may be used for this purpose, or if need be, an entirely separate means may be used for the purpose. The servo-applicator means may take the form of an insertible cartridge which is operable as a pushbutton-like applicator means on the device, or which can be separately employed as a handheld applicator means. The cartridge is commonly equipped with a stick of polishing compound, and in certain embodiments, the stick is removable from the cartridge, for purposes or renewing or replacing the compound, even while the cartridge is inserted in the device. In other embodiments, the cartridge is first removed from the device and then the compound is renewed or replaced before the cartridge is returned to the device.

According to the invention, the device comprises a support having a rotor rotatably mounted thereon for applying an applicator wheel with a cylindrical outline to the shoe, and as indicated, servo-applicator means for applying a polishing compound to the outline of the wheel for transfer to the shoe. The servo-applicator means include pushbutton-like carrier means which are mounted on the support to reciprocate along a parallel to a line intersecting the outline of the wheel. They also include holder means which are mounted on the carrier means to reciprocate in relation to the carrier means along the line, and adapted to support an elongated stick-like body of polishing compound thereon. The body of compound is supported on the holder means so that it projects along the line with the tip thereof oriented toward the outline of the wheel, and there are means operable to position the holder means and thus the tip of the compound with respect to the carrier means along the line. There are also yieldable biasing means which are operable to displace the carrier means in the direction relatively away from the outline of the wheel, and restrainer means which are operable to restrain the carrier means in a position on the support in which, when the holder means has assumed a predetermined position on the line, the body of compound will assume in turn an armed condition in which the tip of it is spaced apart from the outline of the wheel by a predetermined distance therebetween. Accordingly, when the carrier means are displaced the length of said distance in opposition to the bias thereon, the tip of the compound is engaged with the outline of the wheel for transfer of the compound thereto. There are commonly means in the device, moreover, whereby as the compound is consumed, the holder means can be displaced in relation to the carrier means to maintain the body of compound in the armed condition thereof.

In many of the presently preferred embodiments of the invention, the carrier means include a tube-like carrier member which is centered about the aforesaid line on the support and has a pair of oppositely laterally outwardly projecting lugs thereon which are interposed between the restrainer means and the yieldable biasing means to be reciprocated against the bias thereof. The holder means are slidably received in the tube-like member and the positioning means for the same include a jack screw which is threadedly engaged with the holder means in the member. In certain embodiments, the jack screw is rotatably mounted on one end of the member to be driven from a point outside of the support. In other embodiments, the jack screw is rotatably mounted on the periphery of the member and the positioning means further comprise a pair of cooperatively engaged pinion gears which are mounted on the screw and the support to drive the screw from a point outside of the support.

In one group of embodiments, the tube-like member is slidably engaged in a hole in one face of the support. In certain of these embodiments, the end of the member adjacent the one face of the support has a cap thereon, and the jack screw is rotatably mounted in the cap and adapted to project outside thereof so that it can be manually rotated at a point outside of the support. Often the projecting portion of the jack screw is equipped with a rotary knob which provides not only a means for rotating the screw, but also a raised pushbutton surface on the cap. Moreover, the restrainer means are usually selectively operable to release the tube-like member from the hole so that the holder means can be removed from the member to enable the body of the compound to be renewed or replaced after it is consumed.

In certain other embodiments of the group, the tube-like member takes the form of a walled case and the jack screw is rotatably mounted in one wall thereof. There are oppositely disposed openings in the one wall of the member and the adjacent side of the support, and a pair of cooperatively engaged pinion gears is disposed on the jack screw and the support in the openings so that the jack screw can be manually rotated at a point outside of the support. Again, the end of the member adjacent the one face of the support preferably has a cap thereon which provides a raised pushbutton surface on the member. However, in this instance the cap is detachably connected with the member so that the holder means can be removed from the member when the cap is detached therefrom.

In many embodiments, the support is adapted to be carried in one hand and has relatively proximal and distal ends thereon. The rotor is mounted on the support at a point opposite the distal end thereof, and the servo-applicator means are mounted on the proximal end of the support to be operated at a point thereopposite. In certain embodiments, the support is equipped with a series of servo-applicator means, each of which is adapted to apply a different color of polish to the wheel. The device is also equipped with an equal number of applicator wheels, each of which can be detachably connected with the rotor to transfer the color of a different servo-applicator means in the series.

Where a series of servo-applicator means is employed, the device preferably further comprises shutter means which are operably insertible between the rotor and the series of servo-applicator means to prevent all but one servo-applicator means from being operated at a time. In many embodiments, for example, the shutter means comprise an elongated shutter which is reciprocably mounted on the support to be passed between the rotor and the series of servo-applicator means, there being an opening in the shutter that is selectively registerable with one of the servo-applicator means so that the body of compound therein can be displaced through the opening for engagement with the outline of the wheel. Preferably, there are also rotary means on the support for reciprocating the shutter.

In some hand-held embodiments, the support has a depending handle thereon whereby it can be held in pistol-like fashion. Furthermore, the wheel is also adapted as a means for buffing the shoe.

In certain presently preferred embodiments of the device, the holder means has a recess therein in which the body of compound is seated to project along the line. In fact, outside of the device, the servo-applicator means is often simply a hand supportable shoe polishing applicator comprising an applicator stick which in turn comprises such a holder means and an elongated stick-like form-sustainable body of a rub removable shoe polishing compound seated at one end in the recess and projecting outwardly therefrom for application to a shoe. To render the stick operable as a means for arming a shoe polishing device, the holder means will preferably have means thereon for engaging the stick with a reciprocable drive means such as a jack screw. For example, the holder means may have a central aperture therein which is threaded for engagement with a jack screw, there being a central bore in the body of the polishing compound to accomodate the screw. Or the holder means may have a threaded ear on one side thereof for engagement with a jack screw. In fact, in many of the presently preferred embodiments of the applicator, it comprises a tube-like case for the stick, a jack screw rotatably mounted on the case to extend within the same along a parallel to the center line of the case, and means for rotating the screw from a point outside of the case. The holder means are slidably received in the case and threadedly engaged on the screw to be advanced in relation to one end of the case by the screw. In some embodiments, there is a cap on the other end of the case, and the screw is rotatably mounted in the cap on the center line of the case, there being a knob on the screw at the outside of the cap to provide a means for rotating the screw. In other embodiments, the case is a walled member and has an opening in one wall thereof, the screw is rotatably mounted in that one wall, and there is a pinion gear on the screw in the opening to provide a means for rotating the screw at the outside of the case. Preferably, in these last-mentioned embodiments, there is also a cap on the other end of the case, but the cap is detachably connected with that end so that it can be detached for removal of the holder means from the case when the body of compound is consumed.

To render the applicator operable as a cartridge for arming a shoe polishing device of the nature described above, the case will preferably have a pair of oppositely laterally outwardly projecting lugs thereon for interposition between yieldable biasing means and restrainer means on a support for the applicator.

BRIEF DESCRIPTION OF THE DRAWINGS

These features will be better understood by reference to the accompanying drawings wherein two hand-supportable pistol-like embodiments of the device are illustrated. The first employs an applicator cartridge which is commonly permanently installed in the support since the holder means of the stick are readily removable from the case of the cartridge for renewal or replacement of the polishing compound while the case remains in place on the support. The second employs a cartridge which is removable from the support when it is necessary or desirable to renew or replace the compound. This can be done either by replacing the catridge as a whole, or by replacing the holder means in the same with one having a renewed or replacement body of compound thereon.

In the drawings:

FIG. 3 is a right elevational view of the first embodiment in use;

FIG. 4 is a top view of the same;

FIG. 5 is a perspective view of the stick employed in the device;

FIG. 6 is a cross-sectional view of the device along the line 6—6 of FIG. 3;

FIG. 8 is a similar view along the line 8—8 of FIG. 6;

DESCRIPTION OF THE PREFERRED EMBODIMENT

Figure 1:
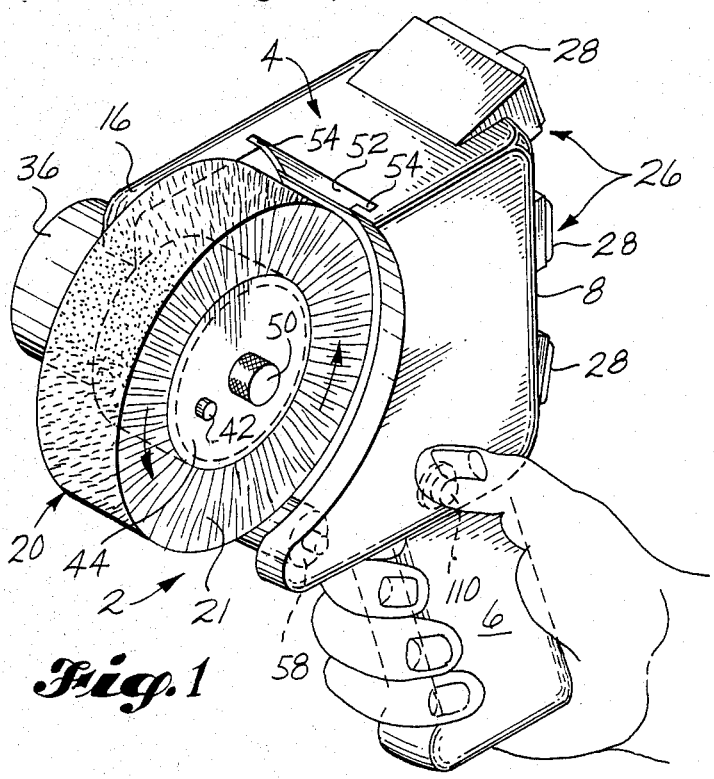
FIG. 1 is a perspective view of the first embodiment in use.
Figure 2:
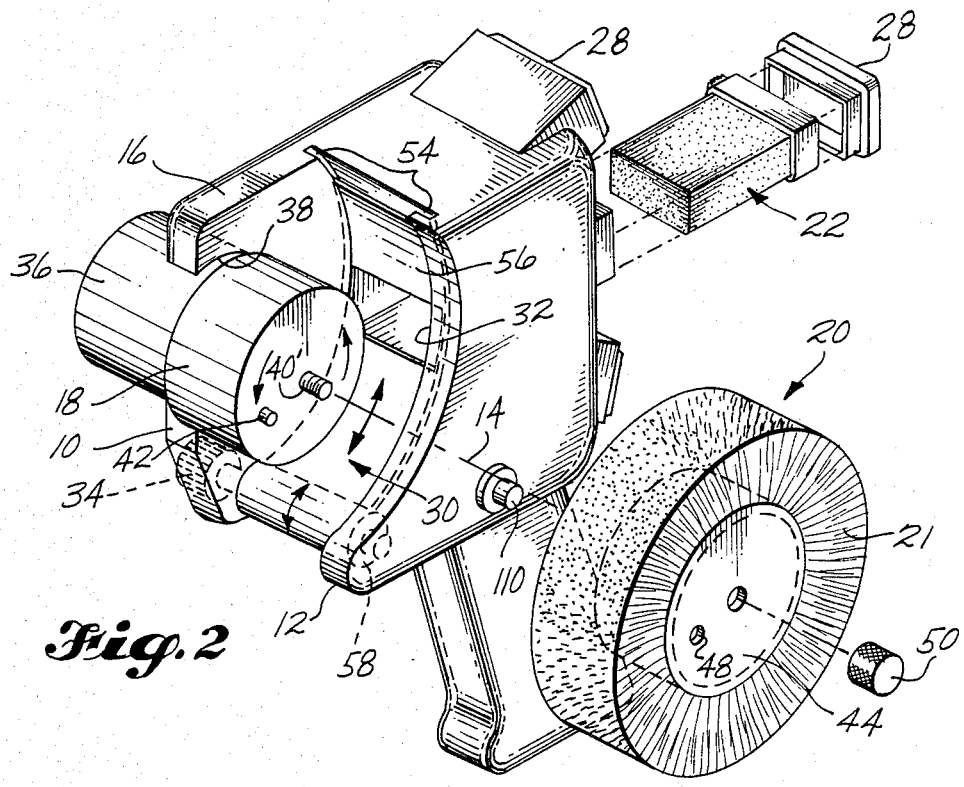
FIG. 2 is a similar but partly exploded view of the same.
Figure 9:
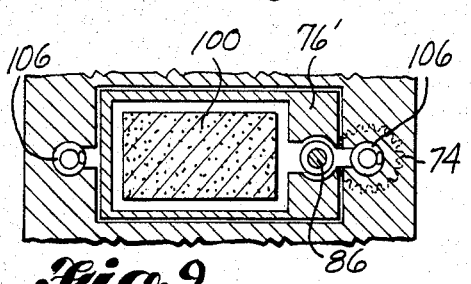
FIG. 9 is another such view along the line 9—9 of FIG. 6.
Figure 10:
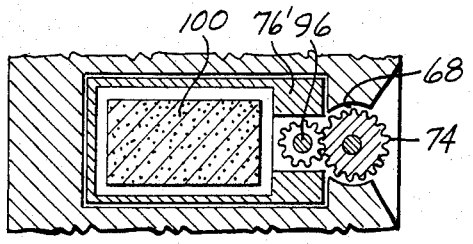
FIG. 10 is a fifth such view along the line 10—10 of FIG. 6.
Figure 7:
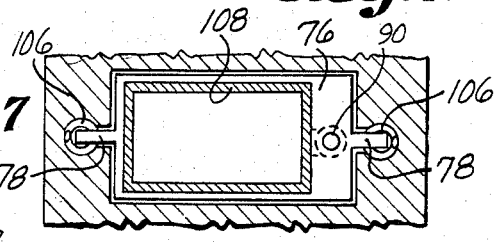
FIG. 7 is a cross-sectional view of the device along the line 7—7 of FIG. 6.

Referring initially to FIGS. 1–5, it will be seen that the first embodiment comprises a pistol-like support 2 which has a stubby, generally orthogonal head 4 and a handle 6 depending from the rearward or proximal end 8 thereof for grasping by the user. The head 4 is slotted at the forward or distal end 10 thereof, to give it a yoke-like appearance, but the left hand arm 12 of the yoke is partially removed about an axis 14 of revolution through the right hand arm 16, to enable a motor driven rotor 18 to be rotatably mounted on the latter arm 16 at the axis 14. The rotor 18 is adapted to be equipped with one of several interchangeable polishing wheels 20, each of which has a cylindrical brush 21 thereon. The respective wheels 20 function as a means for applying one of several colors of polishing compound 22 to the shoe 24 to be polished, as well as a follow up means for buffing the shoe to develop a shine thereon. The polishing compound is supplied to the wheels from a set of pushbutton-like applicators 26 which are housed in the body of the head 4 behind the rotor 18 and operated by the user. Each applicator 26 is equipped with a stick 22 of polishing compound, and the user selects that applicator having the appropriate color of compound. Normally this is apparent from indicia of intelligence (not shown) on the pushbuttons 28 of the respective applicators; but in addition, to assure that only the selected color is supplied to the wheel, a shutter 30 is provided between the unused applicators and the rotor, to render the unused applicators inoperative. The shutter 30 has a single opening 32 that can be used with only one applicator at a time, and the opening is positioned by means of a rotary knob 34 on the right hand arm 16 of the head. Should the user decide to change to a different color, he substitutes a wheel 20 appropriate to that color and shifts the shutter 30 to a position in which the opening 32 registers with that applicator 26 having the selected color.

To elaborate more fully, and referring now to FIGS. 1–10 in particular, it will be seen that there is a small electric motor 36 secured on the axis of the right hand arm 16, within a part cylindrical groove 38 thereof. The motor 36 has an elongated arbor 40 which in turn has a threaded tip 40′ thereon. The rotor 18 is keyed to the arbor inside of the tip, and has a lug 42 outstanding thereon at a location eccentric to the arbor. Each wheel 20 in turn has a recessed or cup-like hub 44 which is apertured to receive the arbor. The recess 46 is adapted so that the wheel can be sleeved over the rotor, there being a hole 48 in the hub 44 that receives the lug 42 so that the wheel interlocks with the rotor for conjoint rotation about the axis. A cap 50 is then threaded onto the tip 40′ of the arbor to secure the wheel in place.

Rearward of the wheel, there is a shallow recess 52 in the front face of the head at the site of the slot between the arms of the yoke. Like the leading edge of the arm 12, the bottom of the recess 52 is defined by a surface of revolution about the axis 14; and to the sides of the recess, there is a pair of oppositely disposed grooves 54 in the walls of the same which are likewise swung on arcs about the axis. The shutter 30 takes the form of a flexible tape 56 which is slidably engaged in the grooves 54 crosswise the recess, and wound about a reel 58 that is rotatably mounted at the lower end of the recess, there being an undercut 60 (FIG. 3) in the slot of the head at this point to accomodate the reel. As indicated, a knurled knob 34 on the right hand end of the reel enables the user to advance and retract the tape 56 in the recess 52 until the opening 32 of the same registers with that applicator 26 having the desired color. Preferably, there are indicia of intelligence on the knob indicating the locations of the respective colors, but again this is not shown.

The applicators 26 are accomodated in a series of holes 62 (FIG. 6) which open into the rear end 8 of the head from the bottom of the shutter recess 52. The holes 62 are rectangular in cross-section and are disposed on radii of the axis at equally angularly spaced intervals thereabout. Each hole 62 is accompanied by a pair of smaller holes 64 which are disposed on parallels to the hole 62 at the center of the right and left hand sides thereof. The respective pairs of holes 64 open into the rear end 8 of the head, but terminate at intermediate points in the body of the head adjacent the radially innermost ends of the larger holes 62. The pairs of smaller holes are also slotted at the inside walls thereof, to open into the bores of the larger holes 62; and the radially outermost ends 64′ of the smaller holes are threaded to accomodate pairs of threaded plugs 66 therein, as shall be explained.

Each through hole 62 is also accompanied by a slot 68 which opens onto the right hand side of the head at a point radially inward of the smaller hole 64 on that side of the head. Each slot 68 is widely flared (FIG. 10) at the outside thereof, and has a pair of socket-like grooves 70 (FIG. 6) in the flanks thereof. The grooves 70 are coaxially disposed in the bottoms of the flanks so that the shanked ends 72 of an elongated, circumferentially toothed pinion gear 74 can be snap engaged in the grooves to place the gear across the mouth of the slot 68. The gear 74 is sized in turn so that the teeth thereof project slightly inside and outside of the slot for purposes to be explained.

Each applicator 26 comprises an elongated, open-ended tubular case 76 which is constructed of semi-rigid plastic material, rectangularly cross-sectioned and adapted to be slidably engaged in the corresponding hole 62 of the head. The case 76 has laterally outstanding lugs 78 on the right and left hand sides thereof at its radially outermost end. It also has a thicker wall 76′ on the right hand side thereof, and there is an elongated hole 80 in that wall which opens into the outermost end of the case at the center of the wall, but terminates at an intermediate point radially inwardly thereof adjacent the innermost end of the case. The hole 80 is slotted at the inside thereof, to open into the bore of the case, and both the radially innermost and outermost ends of the hole have slotted reduced diameter necks 82 and 84 therein. The slotting is adapted so that an elongated jack screw 86 can be inserted into the hole 80 while the unthreaded shanks 88 and 90 thereof are snap engaged in the necks to mount the screw for rotation in the hole. The thicker wall 76′ also has an outwardly opening slot 92 therein at a point radially inward of the screw hole 80, and there is a shallow socket 94 in the radially innermost wall of the slot. The radially innermost shank 88 of the screw 86 is seated in the socket 94 and has a pinion gear 96 fixed thereon. The teeth of the gear 96 are adapted to engage with the teeth of the larger pinion gear 74 in the slot 68 of the head and, moreover, to slide lengthwise thereof when the applicator is put to use, as shall be explained.

The stick 22 (FIG. 5) comprises a rectangularly shaped holding cup 98 having a stick-like form-sustainable body 100 of a rub removable polishing compound seated at one end in the recess 102 (FIG. 6) thereof. The cup 98 also has a threaded ear 104 upstanding on one narrow edge thereof. The threaded portion 104′ of the ear cantilevers outside of the edge, and as seen in FIG. 6, the stick 22 is adapted to be slidably engaged in the bore of the case 76, using the ear 104 as a driver on the screw 86.

The applicator 22 is normally assembled and mounted in the head by first inserting the stick 22 in the bore of the case 76 until the ear 104 engages on the screw 86, and then rotating the smaller pinion gear 96 with one finger or a thumb to advance the stick along the screw until it is fully positioned within the bore of the case. Thereafter, a pair of elongated coil springs 106 is inserted in the holes 64 accompanying the hole 62 to be used for the applicator; and the case is slidably engaged in the hole 62 while the lugs 78 thereof are slidably engaged in the slots 64″ of the holes 64. As seen in FIG. 6, the lugs are adapted to project within the holes 64, and the springs 106 are adapted to be lightly compressed by the lugs as the lugs enter the unthreaded portions of the holes. Furthermore, the gears 74 and 96 are disposed in the head and case, respectively, so that they interengage with one another at this point; and when the lugs 78 are fully recessed in the unthreaded portions of the holes 64, the plugs 66 are inserted in the ends 64′ of the holes to restrain the case in the position of FIG. 6. Thereafter, the larger pinion gear 74 is turned by finger or a thumb until the stick 22 is advanced to a position at which the tip 100′ of the stick closely approaches the tape 56 of the shutter. In this position, the device is armed and ready for use whenever the opening 32 of the shutter is in registry with the stick. However, a cap 28 is commonly snap engaged in the radially outermost end of the case 76 to provide a convenient pushbutton surface for depressing the applicator against the bias of the springs 106.

When the user has adjusted the shutter so that the opening 32 thereof is in registry with the stick, and has mounted a wheel 20 which is compatible with the color of the stick, he can put the device to use by energizing the wheel with a switch 110 (FIGS. 1 and 2) on the left hand side of the head. Then, as he applys the brush 21 of the wheel to the shoe, he can depress the button 28 of the applicator to advance the stick through the opening 32 of the shutter and into engagement with the outline of the brush. This has the effect of coating the outline with the compound 100 so that it is transferred to the shoe as the brush rotates over the surface of the same. On the other hand, each time he releases the applicator, the springs 106 will return the stick to its retracted position, and he can use the wheel solely as a buffer if he wishes. As the stick is consumed, it can be progressively advanced by the gear 74 so as to be continually repositioned just short of the shutter. Due to the length of the gear 74, the gears 74 and 96 will remain engaged after each operation of the applicator. Ultimately, when the stick is fully consumed, the cap 28 can be removed so that the cup 98 can be retracted from the case 76 and a new stick 22 inserted in its place, this time using the gear 74 alone to position it in the case.

Figure 11:
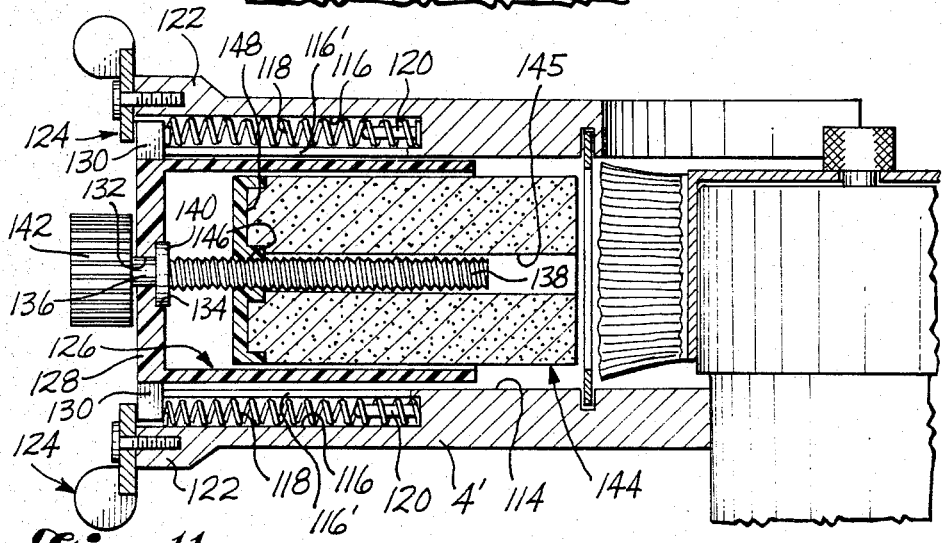
FIG. 11 is a cross-sectional view similar to that of FIG. 6, but showing the second embodiment of the device.
Figure 12:
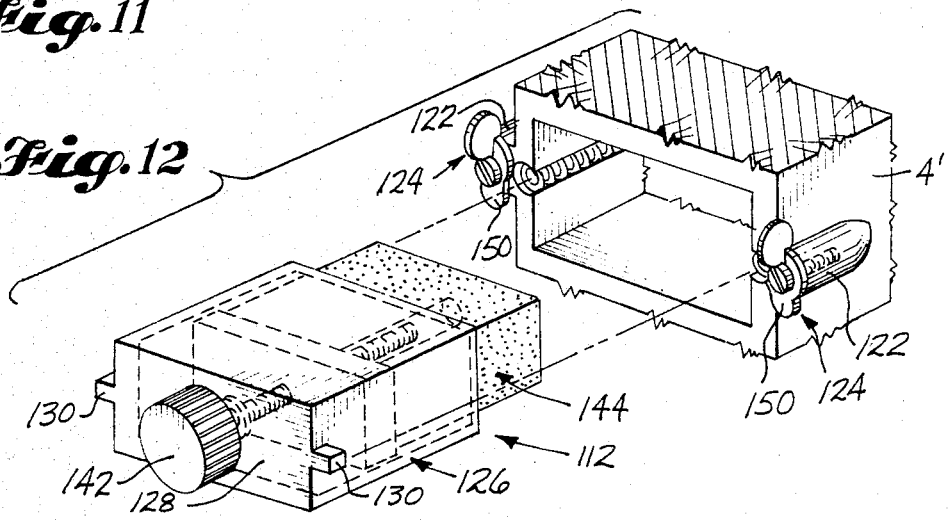
FIG. 12 is a part-perspective exploded view of the second embodiment.

In FIGS. 11 and 12, the cap, stick, case and screw are assembled as a fully or partially replaceable applicator cartridge 112. Once again, the head 4' has radially oriented holes 114 therein and each hole 114 is accompanied by a pair of smaller slotted holes 116 on the right and left hand sides thereof. However, in this instance, the coil springs 118 are seated on posts 120 at the inner ends of the holes 116, and are secured to the same so as to remain in the holes when their outer ends are uncovered. Additionally, the sides of the head have rounded corbels 122 on the outer edges thereof, and a pair of winged tabs 124 is cap screwed to the corbels 122 to swing in and out of registry with the ends of the holes 116.

The cartridge 112 comprises a tubular sheath 126 which is rectangular and closed at the outermost end 128 thereof. The sheath 126 is adapted to be slidably inserted in the corresponding hole 114 of the head and has laterally outstanding lugs 130 on the narrow sides thereof at its outermost end 128. The lugs 130 are adapted to engage in the slots 116' of the holes 116 and to project within the holes 116 so as to engage the outer ends of the springs 118. The outer end 128 of the sheath also has an aperture 132 in the center thereof, the inner end of which is counterbored to form an enlarged socket 134 for the aperture.

The shank 136 of a jack screw 138 is rotatably engaged in the aperture 132 after a washer 140 is placed on the shank 136 to seat in the socket 134. In addition, a larger diameter knob 142 is secured to the outer end of the shank 136 to retain the screw 138 on the end 128 of the sheath and to provide a raised pushbutton surface for the cartridge. The knob 142 is also knurled or otherwise adapted to be gripped for rotation.

The cartridge employs a stick 144 similar to that in FIG. 5, but having a hollow bore 145 in the body thereof and a threaded aperture 146 at the center of its cup 148. The center is also raised to reinforce the journal between the aperture and the cup. After the stick and jack screw 138 are threaded together so as to seat the stick within the sheath, the tabs 124 are turned to a position out of registry with the holes 116 and the cartridge 112 is inserted in the through hole 114. At the same time, the lugs 130 are engaged against the springs 118 in the ends of the holes 116, the springs being subjected to light compression as the lugs enter the holes. When the lugs are fully recessed in the holes, the tabs 124 are rotated to place the tips 150 of the same over the holes 116 and leave the cartridge retained in the hole 114. Moreover, the knob 142 is rotated to position the tip of the stick 144 at a location just short of the shutter, as in FIG. 6, leaving the device loaded for use. As in the embodiment of FIGS. 1–10, the applicator is actuated by placing one finger or a thumb on the knob 142 and depressing it against the bias of the springs 118.

I claim:

1. A shoe polishing device comprising a support having a rotor rotatably mounted thereon which is adapted so that an applicator wheel with a cylindrical outline can be mounted on the same for the transfer of polishing compound to the shoe at the outline of the wheel, servo-applicator means for applying a polishing compound to the outline of the wheel for transfer to the shoe, including pushbutton-like carrier means which are mounted on the support to reciprocate along a parallel to a line intersecting the outline of the wheel, and holder means which are mounted on the carrier means to reciprocate in relation to the carrier means along the line, and adapted to support an elongated stick-like body of polishing compound thereon, the body of compound being supported on the holder means so that it projects along the line with the tip thereof oriented toward the outline of the wheel, and there being means operable to position the holder means and thus the tip of the compound with respect to the carrier means along the line, yieldable biasing means which are operable to displace the carrier means in the direction relatively away from the outline of the wheel, and restrainer means which are operable to restrain the carrier means in a position on the support in which, when the holder means has assumed a predetermined position on the line, the body of compound will assume in turn an armed condition in which the tip of it is spaced apart from the outline of the wheel by a predetermined distance therebetween, the carrier means being displaceable the length of said distance in opposition to the bias thereon, to engage the tip of the compound with the outline of the wheel for transfer of the compound thereto.

2. The device according to claim 1 further comprising means whereby as the compound is consumed, the holder means can be displaced in relation to the carrier means to maintain the body of compound in the armed condition thereof.

3. The device according to claim 1 wherein the carrier means include a tube-like member which is centered about the aforesaid line on the support and has a pair of oppositely laterally outwardly projecting lugs thereon which are interposed between the restrainer means and the yieldable biasing means to be reciprocated against the bias thereof.

4. The device according to claim 3 wherein the holder means are slidably received in the tube-like carrier member and the positioning means for the same include a jack screw which is threadedly engaged with the holder means in the member.

5. The device according to claim 4 wherein the jack screw is rotatably mounted on one end of the member to be driven from a point outside of the support.

6. The device according to claim 4 wherein the jack screw is rotatably mounted on the periphery of the member and the positioning means further comprise a pair of cooperatively engaged pinion gears which are mounted on the screw and the support to drive the screw from a point outside of the support.

7. The device according to claim 4 wherein the tube-like member is slidably engaged in a hole in one face of the support.

8. The device according to claim 7 wherein the end of the member adjacent the one face of the support has a cap thereon, and the jack screw is rotatably mounted in the cap and adapted to project outside thereof so that it can be manually rotated at a point outside of the support.

9. The device according to claim 8 wherein the projecting portion of the jack screw is equipped with a rotary knob which provides not only a means for rotating the screw, but also a raised pushbutton surface on the cap.

10. The device according to claim 7 wherein the restrainer means are selectively operable to release the tube-like member from the hole so that the holder means can be removed from the member to enable the body of the compound to be renewed or replaced after it is consumed.

11. The device according to claim 7 wherein the tube-like member takes the form of a walled case and the jack screw is rotatably mounted in one wall thereof, there being oppositely disposed openings in the one wall of the member and the adjacent side of the support, and a pair of cooperatively engaged pinion gears disposed on the jack screw and the support in the openings so that the jack screw can be manually rotated at a point outside of the support.

12. The device according to claim 11 wherein the end of the member adjacent the one face of the support has a cap thereon which provides a raised pushbutton surface on the member, the cap being detachably connected with the member so that the holder means can be removed from the member when the cap is detached therefrom.

13. The device according to claim 1 wherein the support is adapted to be carried in one hand and has relatively proximal and distal ends thereon, the rotor being mounted on the support at a point opposite the distal end thereof, and the servo-applicator means being mounted on the proximal end of the support to be operated at a point thereopposite.

14. The device according to claim 13 wherein the support has a depending handle thereon whereby it can be held in pistol-like fashion.

15. The device according to claim 1 wherein the support is equipped with a series of servo-applicator means, each of which is adapted to apply a different color of polish to the wheel, and wherein the device further comprises an equal number of applicator wheels, each of which can be detachably connected with the rotor to transfer the color of a different servo-applicator means in the series.

16. The device according to claim 15 further comprising shutter means which are operably insertible between the rotor and the series of servo-applicator means to prevent all but one servo-applicator means from being operated at a time.

17. The device according to claim 16 wherein the shutter means comprise an elongated shutter which is reciprocably mounted on the support to be passed between the rotor and the series of servo-applicator means, there being an opening in the shutter that is selectively registerable with one of the servo-applicator means so that the body of compound therein can be displaced through the opening for engagement with the outline of the wheel.

18. The device according to claim 17 wherein there are also rotary means on the support for reciprocating the shutter.

19. The device according to claim 1 wherein the wheel is also adapted as a means for buffing the shoe.

20. The device according to claim 1 wherein the holder means has a recess therein in which the body of compound is seated to project along the line.

* * * * *